US005715618A

United States Patent [19]

Whang

[11] Patent Number: 5,715,618

[45] Date of Patent: Feb. 10, 1998

[54] BIENNIAL PHOTO ALBUM CALENDAR

[76] Inventor: Yoonsuk Whang, 6022 Moongate Dr., Rancho Palos Verdes, Calif. 90274

[21] Appl. No.: 707,173

[22] Filed: Sep. 3, 1996

[51] Int. Cl.[6] ..... G09D 3/04

[52] U.S. Cl. ..... 40/119; 40/120; 40/122; 283/2

[58] Field of Search ..... 40/107, 119, 120, 40/122; 283/2, 3, 4; 402/79, 500

[56] References Cited

U.S. PATENT DOCUMENTS

| | | | |
|---|---|---|---|
| 3,039,216 | 6/1962 | Nichols . | |
| 3,090,143 | 5/1963 | Arnold | 40/119 |
| 3,513,579 | 5/1970 | Christensen | 40/119 |
| 4,696,118 | 9/1987 | Cross | 40/120 |
| 4,703,571 | 11/1987 | McCarthy | 40/107 |
| 4,783,922 | 11/1988 | Moore | 50/120 X |
| 4,902,042 | 2/1990 | Rassi | 283/2 |
| 5,016,917 | 5/1991 | Dubner et al. | 283/4 |
| 5,033,215 | 7/1991 | Newberry | 40/107 |
| 5,062,229 | 11/1991 | Werjefelt | 40/107 |
| 5,123,191 | 6/1992 | Kim | 40/120 X |
| 5,292,154 | 3/1994 | Williams | 283/2 |
| 5,426,876 | 6/1995 | Jagoe et al. . | |
| 5,509,746 | 4/1996 | Ho | 402/79 |

FOREIGN PATENT DOCUMENTS

| | | | |
|---|---|---|---|
| 2212444 | 7/1989 | United Kingdom | 283/2 |

*Primary Examiner*—Brian K. Green
*Attorney, Agent, or Firm*—James Y. Song

[57] ABSTRACT

A biennial photo album calendar has at least twelve calendar pages that are bound and supported by a stand. Each calendar page has a photo holding member and a calendar section on the same page. The calendar section displays calendar information of two separate months, each of which represents the same designated month for two consecutive calendar years. Each calendar page displays a unique designated month selected from twelve months in a calendar year. In the preferred embodiment, the photo holding member is a plastic sleeve, and the stand is a hinged stand.

8 Claims, 5 Drawing Sheets

BIENNIAL PHOTO ALBUM CALENDAR

BACKGROUND OF THE INVENTION

1. Field of the Invention

This invention relates to a photo album, and in particular to a biennial photo album calendar.

2. Description of the Related and Prior Arts

Many combinations of a photo album and a calendar have been devised in the past. In an attempt to give calendar users a choice to customize the calendars, several versions of the calendars which allow the user to mount or otherwise insert a photograph of his own choosing have been invented. Thus, there are currently photo album calendars available that allow the users to place the pictures, photographs, or even artworks in the photo display page, which is usually bound to a calendar display page. The chief advantage of these calendars is that they allow the users to change the picture, photograph, or the artwork on the photo display page conveniently. This type of a photo calendar, although serving a dual functions of photo display and calendar, is often not suitable as a gift, keepsake or memento for the following reasons: Firstly, most of the available photo album calendars have separate pages for photo display and calendar display. For that reason, when the user looks at the photograph that has been inserted into or otherwise mounted on the photo display page, the photograph necessarily appears separated or detached from the calendar display, usually by a binding means or a crease caused by folding of pages. This binding means or crease formed between two separage pages is not aesthetical. This is especially a problem if the user wants a sense of unity between the displayed photograph and the month in which the photograph was taken. Secondly, the currently available photo ablum calendars display a calendar for only twelve months. Therefore, unless a user purchases the calendar prior to the first two or three months of the particular calendar year, the photo album calendar becomes obsolete as a gift. For example, if a person's graduation is in June, a photo album calendar that only has twelve months will not be very useful to the receipient because he would only have seven more months to enjoy the calendar. Another disadvantage of the photo album calendar with only twelve months of calendar is that it does not give the user an option to use the same calendar for the second year while reminiscing and remembering about the events that have just passed and been captured in the photographs. For instance, if the user takes a picture of the birth of his daughter in July of 1996, he would want the daughter's birth picture on the same page that displays the calendar of July of 1996. When the user's daughter is one month old, the father would want to insert the picture of his daughter after one month of growth on the calendar page displaying the calendar of August, 1996, so that he would be able to keep a track of the growth of his daughter by month. After the first year, the calendar would have 12 memorable photographs, each representing a significant event in each of the preceding 12 months. At that time as the new year approaches, many people might want to keep the calendar to reminisce or remember the past year, but he would normally have to buy another calendar for the new year. Thirdly, there does not exist a photo album calendar that not only combines the functions of a photo album and calendar, but also functions as a photo frame that can be displayed on a flat surface, such as a desktop, a kitchen counter, or a windowsill. Thus there exists a need for a photo album calendar that can be sold not only during the first two or three months of the year but throughout the year as a gift or for personal use. There also exists a need for photo album calendar that can display a photograph and the calendar information on the same page so that there would be no appearance of separation between the photograph and calendar display. Furthermore, this improved photo album calendar must be able to stand in a substantially upright position on any flat surface. It must also allow the user to flip or rotate the calendar pages easily and conveniently to expose the subsequent calendar pages. Additionally, this improved photo album calendar must provide features that will allow the users to store or transport the calendar in a form that is compact and convenient.

SUMMARY OF THE INVENTION

The present invention, a biennial photo album calendar, overcomes these problems. A biennial photo album calendar has at least twelve calendar pages. Each calendar page has a photograph holding member and a calendar section on the same page. The calendar section displays the monthly calendar of one designated month for two consecutive years. Each of the twelve calendar pages is used for one designated month, which is unique among the twelve months in a year. For example, the first calendar page for the biennial photo album calendar made for 1997 will have the calendar information of January of 1997 and 1998. A stand that is bound to the calendar pages is provided so that it can support the biennial photo album calendar in a substantially upright position on a flat surface. The calendar pages are hingeably bound so that each of the calendar pages may be flipped or rotated about the binding means. It is an object of the present invention to display a photo and the monthly calendar on the same page so that there would be no appearance of separation between the photograph and the monthly calendar. Another object of the invention is to extend the marketability of the photo album calendar from first two to three months of a year to twelve to fifteen months, counting from the first month displayed in the biennial photo album calendar. It is also an object of the present invention to display the calendar of the same month of at least two consecutive years, so that if the user purchases it prior to the first month of displayed calendar, he will have an option to use the same calendar for at least two years, thus being able to enjoy the photographs taken of the events that happened during same month of the first of two years. It is also an object of the present invention to provide a suitable stand that can support the plurality of the calendar pages on a flat surface so that the photo album calendar will function similarly as a stand-alone photo frame. The stand must also be folded into a relatively flat and compact state so that the present invention can be stored or transported conveniently. These and other objects of the present invention will become apparent from the following detailed descriptions.

DETAILED DESCRIPTION OF THE PREFERRED EMBODIMENTS

Figure 1:
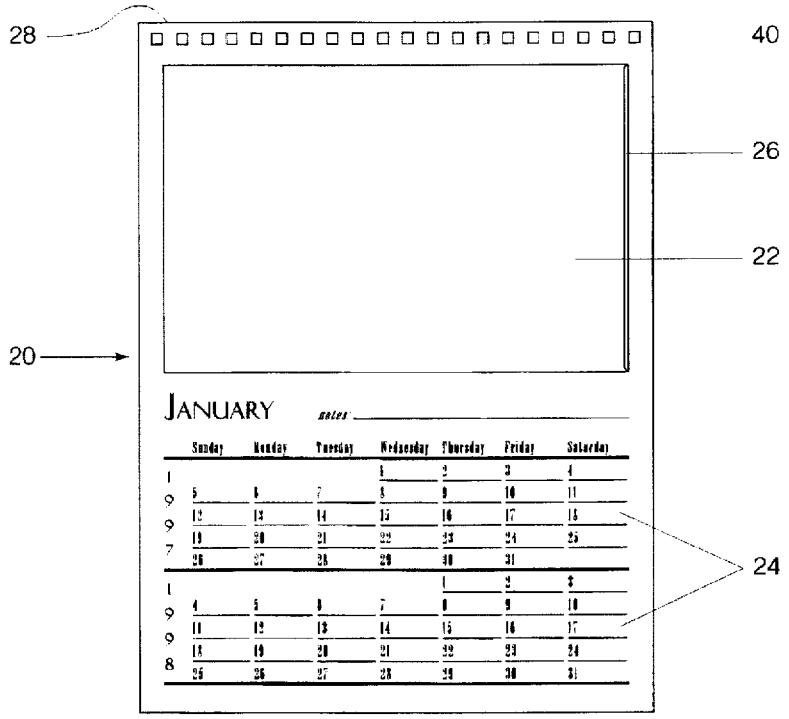
FIG. 1 is a front view of a calendar page.
Figure 1A:
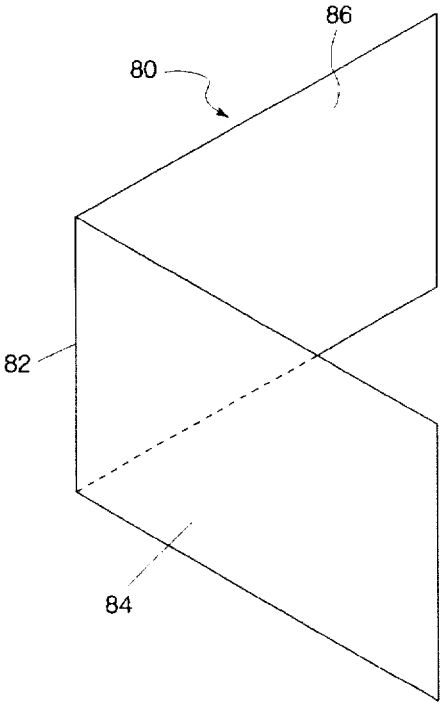
FIG. 1A is a perspective view of a plastic sleeve before sealed on its top and bottom edges.
Figure 1B:
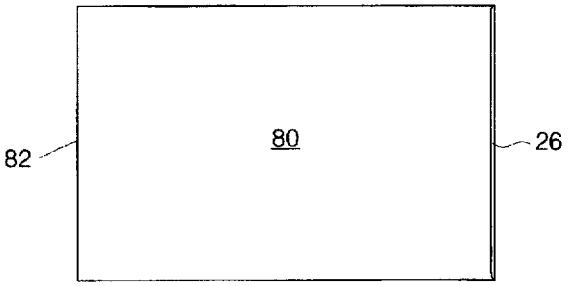
FIG. 1B is a front view of a plastic sleeve in its final form.

FIG. 1 shows a calendar page 20. Each calendar page 20 includes a photo holding member 22 and a calendar section 24. In the preferred embodiment, the photo holding member 22 is a plastic sleeve 80, shown in FIG. 1A and FIG. 1B. The plastic sleeve 80 is made from one thin plastic sheet that is once folded horizontally to form a creased left edge 82, a front layer 84, and a backing layer 86. The top and bottom edges of the front layer 84 and the backing layer 86 are sealed by commonly available adhesive means, leaving the right side unsealed and open. This unsealed side forms an insertion opening 26, through which a photograph can be slidably inserted or removed. The length of the front layer 84 is slightly shorter than the length of the backing layer 86 so as to create a larger opening for quicker and easier insertion or removal of the photograph. The plastic sleeve 80 is then attached to the upper section of the calendar page by commonly available glue designed for use with the paper and plastic sheet. In addition to holding a photograph, the plastic sleeve 80 also adds a high gloss finish to the photograph print. It also protects the photograph from dust, dirt, scratches, fingerprints, and other similar contaminants that are detrimental to the longevity of the photograph quality.

The calendar section 24 is printed with the monthly calendar of a designated month for two consecutive years. Since the monthly calendars for two consecutive years are printed on the same page, twelve such calendar pages are needed to cover all twelve months for two years. Thus, each of the twelve calendar pages has one designated month that is unique among the twelve calendar pages. For example, if the first calendar page of the biennial photo album calendar has the monthly calendar of January of 1997 and 1998, then the second calendar page will have the monthly calendar of February of 1997 and 1998. For that particular sequence, the last calendar page will be the monthly calendar of December of 1997 and 1998. Each of the calendar pages 20 also has a plurality of binder holes 40 disposed along its top edge 28.

Figure 2:
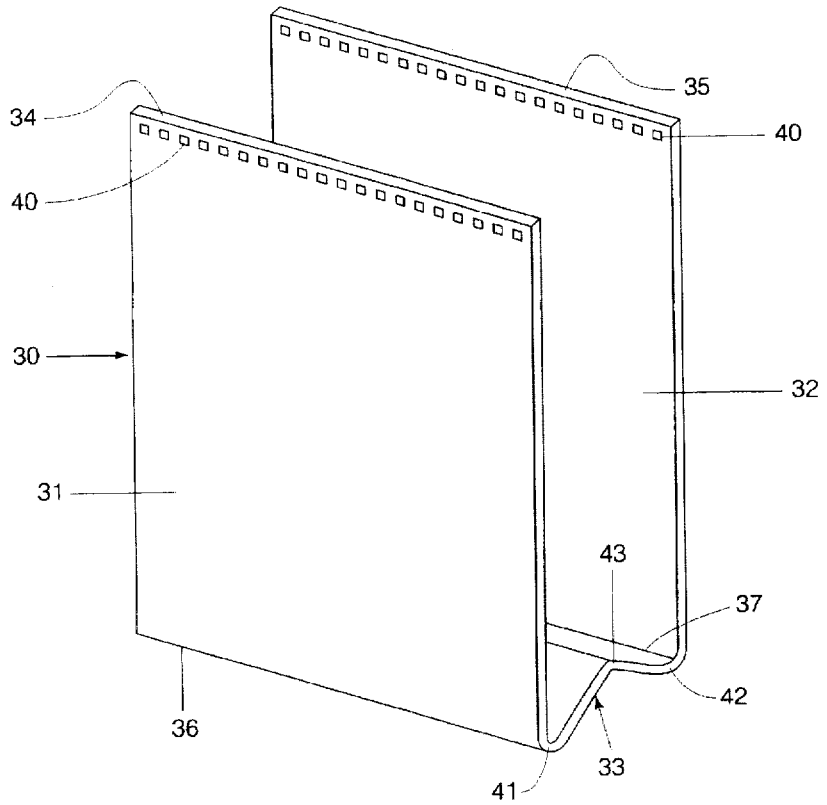
FIG. 2 is a perspective view of a hinged stand prior to being bound to the calendar pages.
Figure 3:
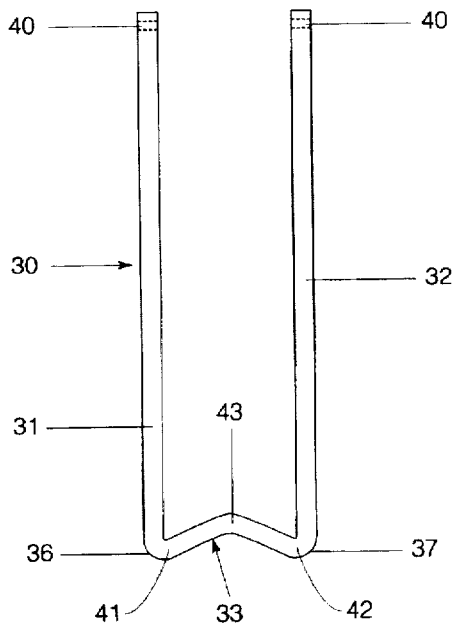
FIG. 3 is a side elevational view of the hinged stand showing the locations of the hinges.

FIG. 2 and FIG. 3 show a hinged stand 30. The hinged stand 30 has a front board 31, a rear board 32, and a spreader 33, which are made from a rigid and stiff cardboard, ornamentally painted or wrapped with colorful papers to have a pleasing look. The front board 31 has a front board top edge 34, a front board bottom edge 36, and a plurality of binder holes 40 disposed along the front board top edge 34. The rear board 32 has a rear board top edge 35, a rear board bottom edge 37, and a plurality of binder holes 40 disposed along the rear board top edge 35. Both of the front board 31 and the rear board 32 are of the same shape and size as the calendar page 20. One side of the spreader 33 is connected to the front board bottom edge 37 by a front hinge 41, and the other side of the spreader 33 is connected to the rear board bottom edge 38 by a rear hinge 42. The spreader 33 also has a middle hinge 43, which is positioned parallel to the front hinge 41 and the rear hinge 42, and located centrally and longitudinally in the middle of the spreader 33, effectively dissecting the spreader 33 into two substantially equal sections. In this preferred embodiment of the invention, the front hinge 41, the rear hinge 42, and the middle hinge 43 are all paper hinges.

Figure 4:
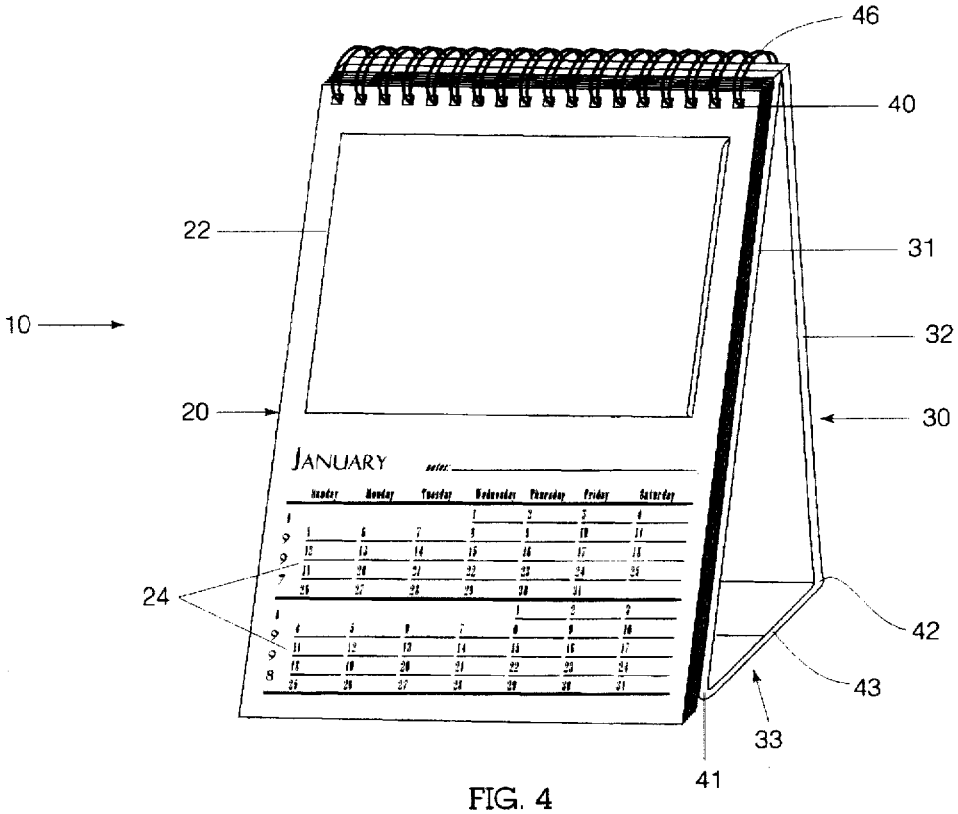
FIG. 4 is a perspective view of a biennial photo album calendar according to the preferred embodiment of the present invention.

FIG. 4 shows the biennial photo album calendar according to the preferred embodiment of the invention. Twelve calendar pages 20, each displaying in its calendar section 24 a different monthly calendar for two consecutive years, are joined with the front board 31 and the rear board 32 by binders 46 cooperating with the plurality of binder holes 40. As used in this embodiment, the binders 46 are plastic coated wire rings that are not connected to each other. The smooth surface of the plastic coated wire rings allow effortless rotation of the calendar pages about a horizontal axis created by the binders 46. A spiral wire, or any suitable variation, can be used in place of the wire rings.

Figure 5:
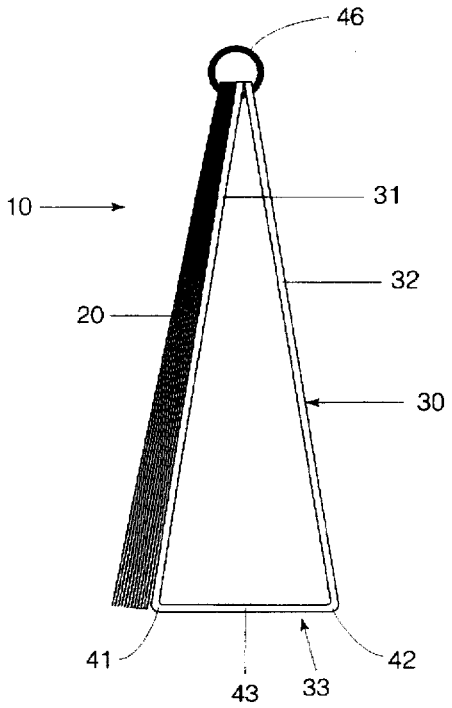
FIG. 5 is a side elevational view of the biennial photo album calendar with the spreader expanded to its full width and the middle hinge unhinged.

The FIG. 5 shows a side elevational view of the biennial photo calendar album 10 with twelve calendar pages 20 and the hinged stand 30 joined together by the binders 46, with the spreader 33 expanded to its full width between the front board 31 and the rear board 32, thereby supporting the biennial photo album calendar 10. The expanded spreader 33 thus functions as a base for the hinged stand 30, together with the front hinge 41 and the rear hinge 42. Pushing the front board 31 and the rear board 32 toward each other will cause the front hinge 41 and the rear hinge 42 to hinge and cause the spreader 33 to fold at the middle hinge 43, which will move upwardly and cause the spreader 33 to fold between the front board 31 and the rear front board 34. When the spreader 33 is folded, the hinged stand 30 collapses to form a substantially flat box-like shape, which is convenient for storage and safe keeping.

Figure 6:
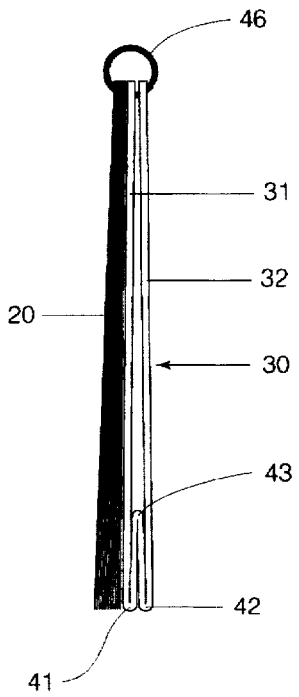
FIG. 6 is a side elevational view of the biennial photo album calendar with the spreader folded between the front board and the rear board.

FIG. 6 shows the biennial photo album calendar with the spreader 33 folded between the front board 31 and the rear board 32. When the front board 31 and the rear board 32 are pulled apart from each other, the middle hinge 43 hinges and moves downwardly, causing the spreader 33 to expand again. Since the middle hinge 43 can be adjusted to hinge to a degree of the user's liking, the hinged stand 30 is an adjustable stand that can not only change the shape of the hinged stand 30, as shown in FIG. 5 and FIG. 6, but it can also control to a limited degree the angle at which the biennial photo album calendar stands on a flat surface, depending on the extent of the hinge created by the middle hinge 43.

Figure 7:
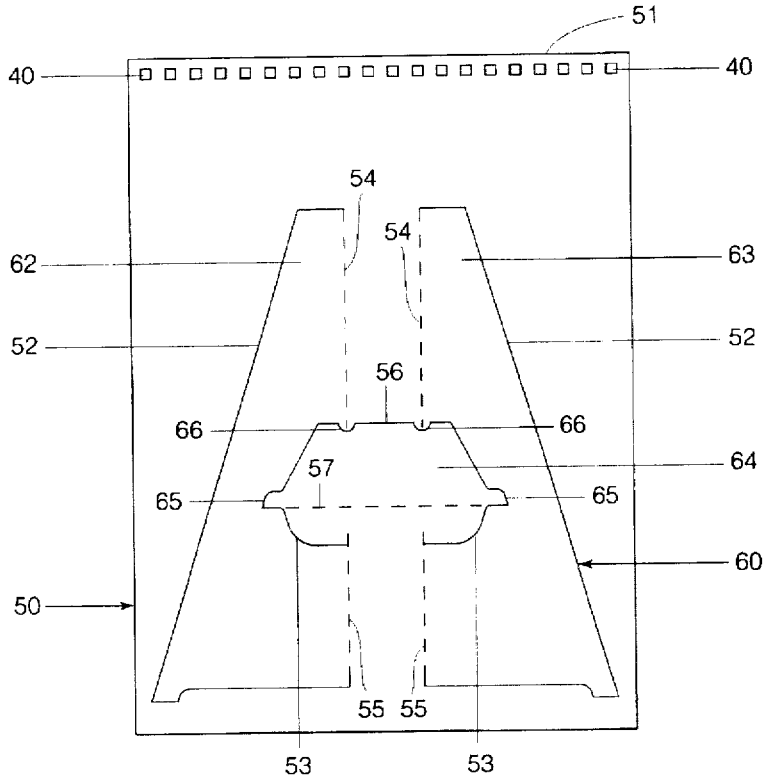
FIG. 7 is a rear view of a back cover that shows the cutlines and an integral fold-out stand bounded by the cutlines in the flush position.
Figure 8:
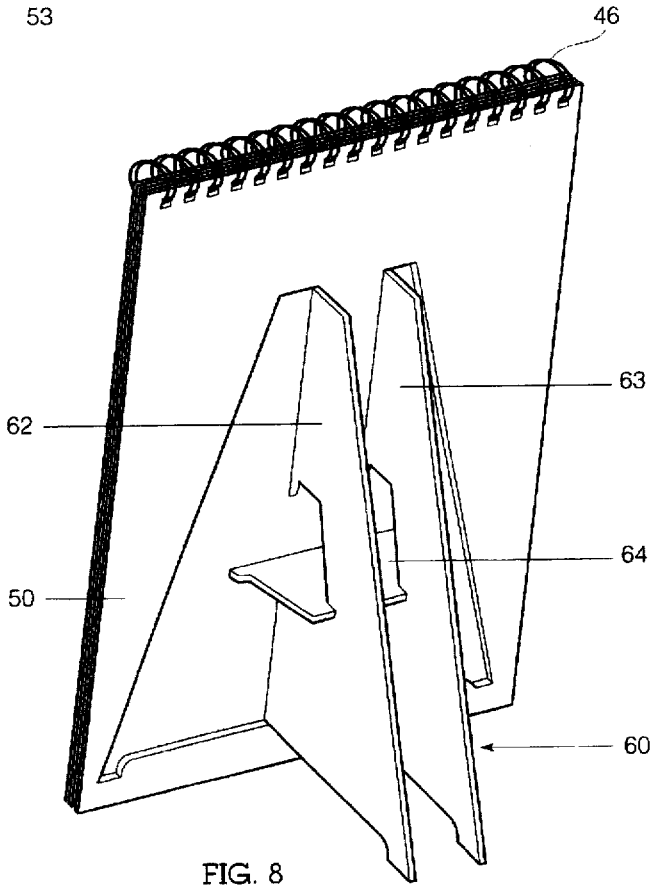
FIG. 8 is a rear perspective view of the biennial photo album calendar with the fold-out stand deployed outwardly from the back cover in a locked position, thereby supporting the biennial photo album calendar.

In an another embodiment of the invention shown in FIG. 7 and 8, a back cover 50 with an integral fold-out stand 60 is bound to a plurality of calendar pages 20 to construct a biennial photo album. FIG. 7 shows a rear view of the back cover 50 with various cutlines that shape the hinged stand 30. The back cover 50 is of the same shape and size as the calendar page 20, and has a back cover top edge 51. There is a plurality of binder holes 40 disposed along the back cover top edge 51. The back cover 50 has the fold-out stand 60, which is flat and integral within the back cover 50 in the flush position. The fold-out stand 60 includes vertical members 62 and 63, each of which is a mirror image of the other and horizontally spaced apart from each other. The fold-out stand 60 also includes a horizontal support 64 disposed between the intermediate portions of the vertical members 62 and 63. Each of the vertical members 62 and 63 is bounded by cut lines 52 and 53 and hinge lines 54 and 55. Hinge lines 54 and 55 form a straight line for ease of bending therealong. The horizontal support 64 is bounded by cut line 56 and hinge line 57. Portions of cutlines 56 are common with portions of cut lines 53, as shown in FIG. 7. The vertical members 62 and 63 each includes a notch 65 disposed along its inner intermediate portion which locks with a respective notch 66 disposed at each end portion of the horizontal support 64 such that when the vertical members 62 and 63 are folded along hinge lines 54 and 55, and the horizontal support 64 along hinge line 57 to substantially transverse positions relative to the back cover 50, the vertical members 62 and 63 will lock with the horizontal support 64 to insure that the fold-out stand 60 remain in the deployed position, as shown in FIG. 8. By unlocking the horizontal support 64 and putting fold-out stand back into the flush position with the back cover 50, the fold-out stand again becomes integral with the flat back cover 50, which enables convenient storage and safekeeping of the biennial photo album calendar.

Figure 9:
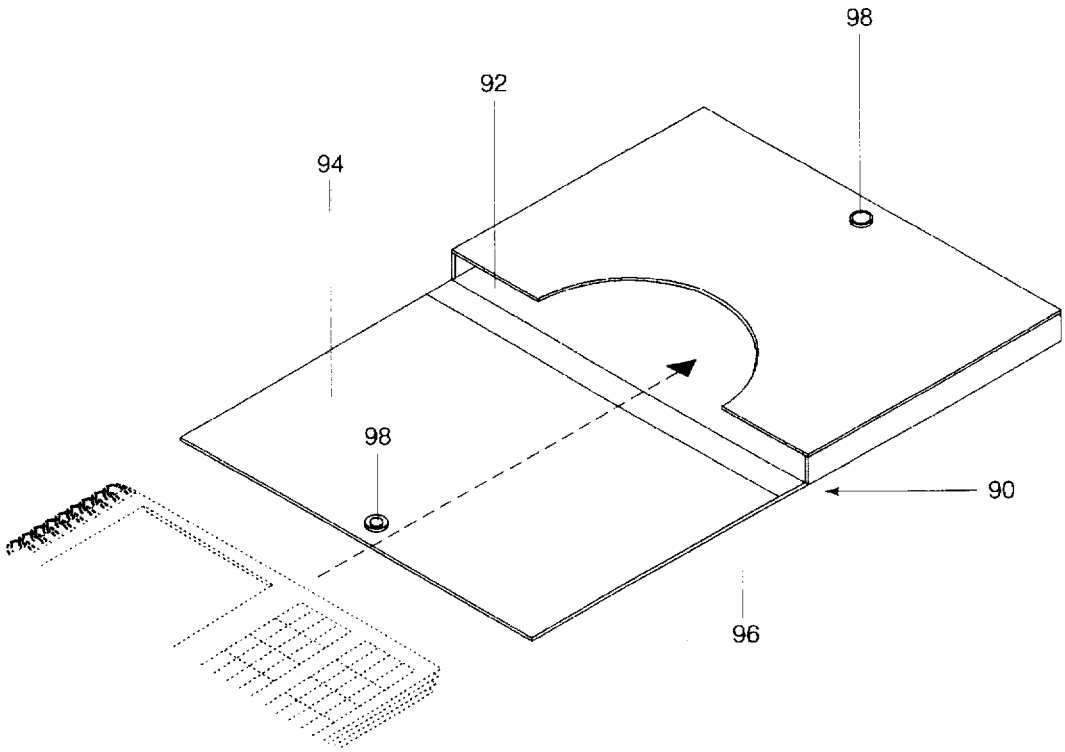
FIG. 9 is a perspective view of a calendar case with its cover open.
Figure 10:
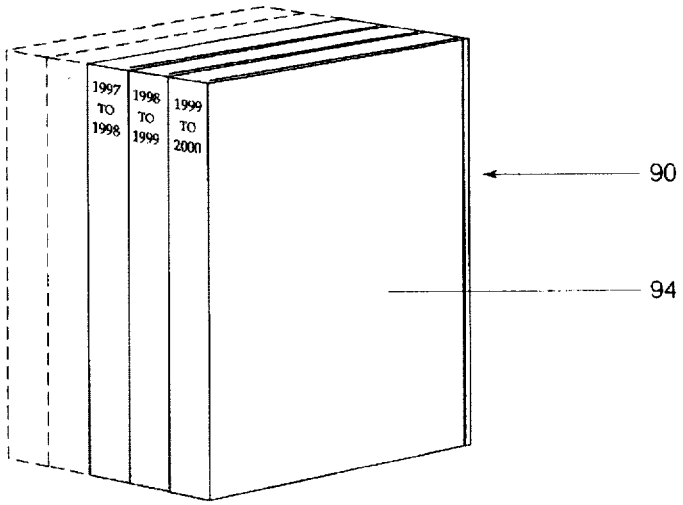
FIG. 10 is a perspective view of the calendar cases as they are displayed on a book shelf.

FIG. 9 shows a calendar case 90 that is made from a commonly available rectangular box with a calendar case opening 92 on one side the calendar case for insertion and removal of the biennial photo album calendar. The calendar case 90 should be large enough to accommodate a biennial photo album calendar 10 with its stand collapsed or folded, so that the entire biennial photo album calendar 10 is in a compact and flat state. Therefore, for the biennial photo album calendar with the hinged stand 30, the spreader 33 must first be folded and tucked in between the front board 31 and the rear board 32 as shown in FIG. 6 before the biennial photo album calendar can be inserted and stored in the calendar case 90. For the biennial photo album calendar with the integral fold-out stand, the fold-out stand 60 first must be unlocked from the notches 65 and 66, and be pushed back into the flush position within the back cover 50 so as to make the back cover 50 flat. The case 90 is made from a standard cardboard, ornamentally designed or wrapped. The case 90 may also have a cover 94, which is hingeably attached to the case by a paper hinge 96. The cover 94 can cover the calendar case opening by wrapping around the calendar case opening side and being secured by any standard meshing means 98, such as a pair of Velcro or permanent magnets. The FIG. 10 shows how a stack of calendar cases can be arranged and displayed on a bookshelf in a manner similar to the way the books are stored and displayed for easy access and retrieval.

What is claimed is:

1. A biennial photo album calendar comprising:

at least twelve calendar pages, each of said at least twelve calendar pages being substantially rectangular and having a top edge, a plurality of binder holes disposed along said top edge, a photo holding member attached below said plurality of binder holes, and a calendar section;

said photo holding member suitable for holding a photograph and further allowing said photograph to be inserted or removed from said photo holding member conveniently without damaging said photograph;

said calendar section displaying calendar information of only two separate calendar months, first of said two separate calendar months being a designated month of a first calendar year and second of said two separate calendar months being said designated month of a second calendar year, said designated month being one month selected from January, February, March, April, May, June, July, August, September, October, November, and December;

said calendar information having numbers and letters forming indicia necessary to identify days, dates, and weeks of said two separate calendar months;

said designated month being unique for each of said at least twelve calendar pages; said first calendar year and said second calendar year being two consecutive calendar years;

a stand for supporting said at least twelve calendar pages;

means for binding said at least twelve calendar pages and said stand such that each of said at least twelve calendar pages may be rotated about said binding means to rest on said stand and to expose a subsequent calendar page of said at least twelve calendar pages.

2. A biennial photo album calendar according to claim 1, wherein said stand is a hinged stand comprising:

a front board, a rear board, and a spreader;

said front board having a front board top edge and a front board bottom edge;

said rear board having a rear board top edge and a rear board bottom edge;

said front board and said rear board further having a plurality of binder holes disposed along said front board top edge and said rear board top edge respectively; and said spreader having two sides and a middle hinge, said middle hinge longitudinally and centrally located therein and dissecting said spreader into two substantially equal sections, one side of said spreader connected to said front board bottom edge by a front hinge and the other side of said spreader connected to said rear board bottom edge by a rear hinge.

3. A biennial photo album calendar according to claim 2, wherein said front hinge, said rear hinge, and said middle hinge are paper hinges.

4. A biennial photo album calendar according to claim 2, wherein said binding means comprises a plurality of wire rings, each of said wire rings inserted through and operable within each of said binder holes.

5. A biennial photo album calendar according to claim 2, wherein said photo holding member is a plastic sleeve.

6. A biennial photo album calendar according to claim 2, further comprising a box-shaped calendar case made from a cardboard and suitable for accommodating said biennial photo album calendar therein when said spreader is completely folded between said front board and said rear board, said box-shaped calendar case being able to stand vertically and having an opening through which said biennial photo album calendar can be inserted or removed.

7. A biennial photo album calendar according to claim 1, wherein said photo holding member is a plastic sleeve.

8. A biennial photo album calendar according to claim 1, further comprising a box-shaped calendar case made from a cardboard and suitable for accommodating said biennial photo album calendar therein, said box-shaded calendar case being able to stand vertically and having an opening through which said biennial photo album calendar can be inserted or removed.

* * * * *